US011670886B2

(12) United States Patent
Tsuchiya

(10) Patent No.: US 11,670,886 B2
(45) Date of Patent: Jun. 6, 2023

(54) CONNECTOR HAVING IMPROVED HOLDING FORCE FOR TERMINAL

(71) Applicant: SUMITOMO WIRING SYSTEMS, LTD., Mie (JP)

(72) Inventor: Takahiro Tsuchiya, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/389,776

(22) Filed: Jul. 30, 2021

(65) Prior Publication Data

US 2022/0045453 A1 Feb. 10, 2022

(30) Foreign Application Priority Data

Aug. 7, 2020 (JP) ..... JP2020-134674

(51) Int. Cl.
*H01R 13/428* (2006.01)
*H01R 13/506* (2006.01)

(52) U.S. Cl.
CPC ..... *H01R 13/428* (2013.01); *H01R 13/506* (2013.01)

(58) Field of Classification Search
CPC ..... H01R 13/428; H01R 13/4223; H01R 13/4361; H01R 13/506; H01R 13/514; H01R 13/639
See application file for complete search history.

(56) References Cited

U.S. PATENT DOCUMENTS

| | | | | |
|---|---|---|---|---|
| 5,380,220 | A * | 1/1995 | Okabe | H01R 13/506 439/456 |
| 5,419,722 | A * | 5/1995 | Onoda | H01R 13/4223 439/752 |
| 5,779,506 | A * | 7/1998 | Okabe | H01R 13/4361 439/752 |
| 6,338,638 | B2 * | 1/2002 | Kodama | H01R 13/432 439/246 |
| 10,644,427 | B2 * | 5/2020 | Matsuura | H01R 13/4223 |
| 10,944,217 | B2 * | 3/2021 | Maesoba | H01R 4/185 |
| 2021/0036460 | A1 | 2/2021 | Miyamura et al. | |

FOREIGN PATENT DOCUMENTS

| | | |
|---|---|---|
| JP | 2019-204747 A | 11/2019 |
| JP | 2020-074346 A | 5/2020 |

* cited by examiner

*Primary Examiner* — Oscar C Jimenez
(74) *Attorney, Agent, or Firm* — Venjuris, P.C.

(57) ABSTRACT

A housing 11 includes a base wall 14, left and right side walls 15 rising from the base wall 14, and an open portion 16 open outward at a position facing the base wall 14. An inner surface of the base wall 14 and inner surfaces of the left and right side walls 15 constitute an inner surface of a cavity 18. A recess 21 is provided in the inner surface of the base wall 14. A resiliently deformable resilient portion 24 is provided to project on the side wall 15. The terminal 60 includes a protrusion 66 to be arranged inside the recess 21 and a surface portion 67 facing the resilient portion 24 from a side opposite to the open portion 16.

5 Claims, 6 Drawing Sheets

CONNECTOR HAVING IMPROVED HOLDING FORCE FOR TERMINAL

CROSS-REFERENCE TO RELATED APPLICATIONS

This application is based on and claims priority from Japanese Patent Application No. 2020-134674, filed on Aug. 7, 2020, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2019-145209 includes an inner housing (hereinafter, referred to as a housing) having a terminal accommodation chamber (hereinafter, referred to as a cavity) and a terminal to be arranged inside the cavity. The cavity is shaped to extend in a front-rear direction. The terminal is forcibly inserted into the cavity from behind. Connectors of this type are also disclosed in Japanese Patent Laid-open Publication Nos. 2019-204747 and 2020-074346.

SUMMARY

In the case of Japanese Patent Laid-open Publication No. 2019-145209, when the terminal is inserted into the cavity, the housing may be scraped by a projection part of the terminal and a holding force for the terminal may be reduced.

Accordingly, the present disclosure aims to provide a connector capable of preventing a reduction in holding force for a terminal.

The present disclosure is directed to a connector with a housing including a cavity extending in a front-rear direction, and a terminal to be arranged inside the cavity, wherein the housing includes a base wall, left and right side walls rising from the base wall in a direction intersecting the front-rear direction, and an open portion open outward at a position facing the base wall, an inner surface of the base wall and inner surfaces of the left and right side walls constitute an inner surface of the cavity, a recess is provided in the inner surface of the base wall, a resiliently deformable resilient portion is provided to project toward the inside of the cavity on at least one of the left and right side walls, and the terminal includes a protrusion to be arranged inside the recess and a surface portion facing the resilient portion from a side opposite to the open portion.

According to the present disclosure, it is possible to provide a connector capable of preventing a reduction in holding force for a terminal.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
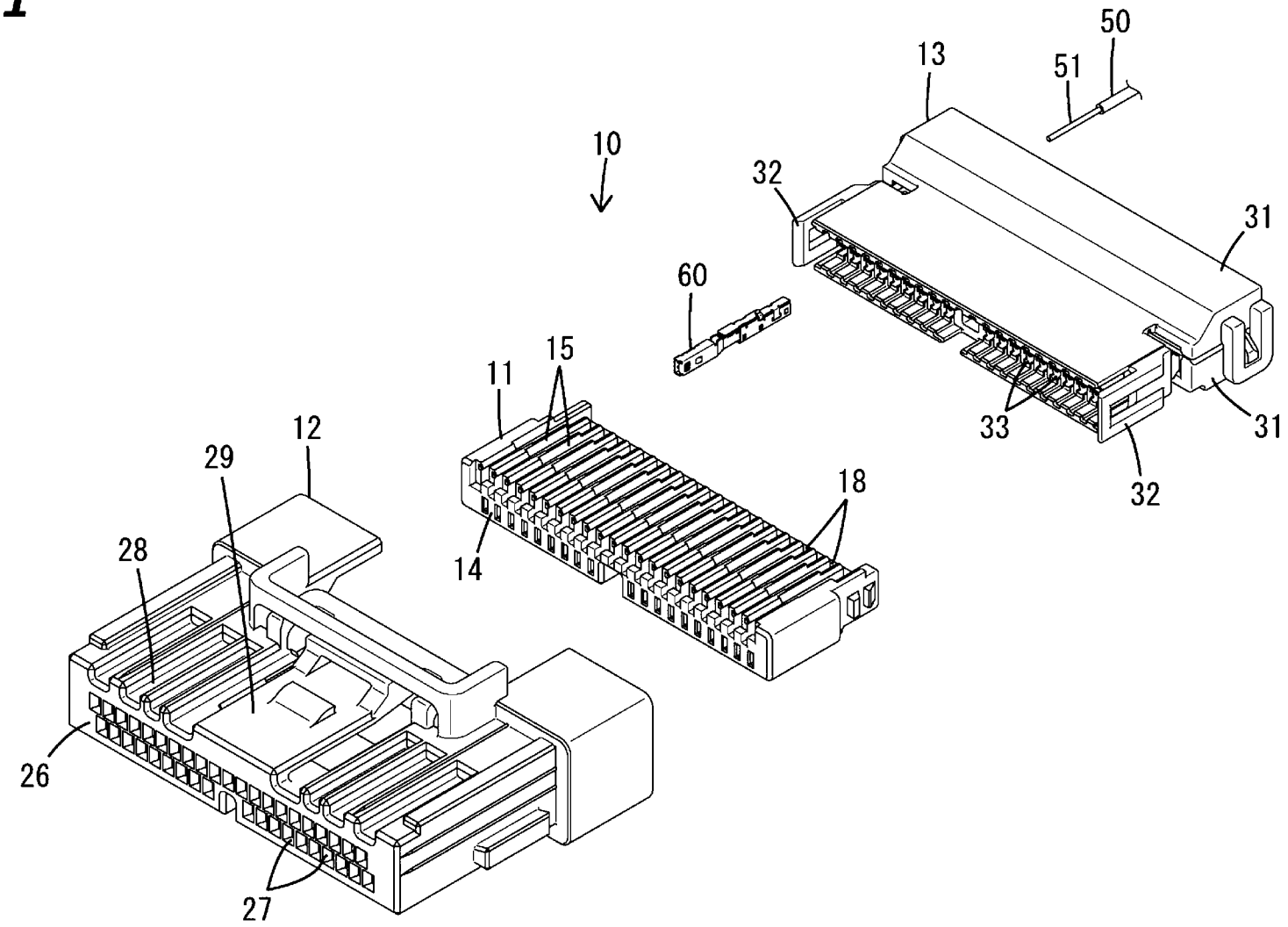
FIG. 1 is an exploded perspective view of a connector of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure is provided with a housing including a cavity extending in a front-rear direction, and a terminal to be arranged inside the cavity, wherein the housing includes a base wall, left and right side walls rising from the base wall in a direction intersecting the front-rear direction, and an open portion open outward at a position facing the base wall, an inner surface of the base wall and inner surfaces of the left and right side walls constitute an inner surface of the cavity, a recess is provided in the inner surface of the base wall, a resiliently deformable resilient portion is provided to project toward the inside of the cavity on at least one of the left and right side walls, and the terminal includes a protrusion to be arranged inside the recess and a surface portion facing the resilient portion from a side opposite to the open portion.

According to this configuration, the terminal is inserted into the cavity through the open portion. In the process of inserting the terminal, the resilient portion is resiliently deformed to allow an inserting operation of the terminal. With the terminal inserted inside the cavity, the protrusion is arranged inside the recess to restrict a displacement of the terminal in the front-rear direction. Further, the escape of the terminal from the open portion is restricted by arranging the surface portion to face the resilient portion. Thus, the terminal needs not be forcibly inserted into the cavity and a concern of breaking the housing can be reduced. As a result, a reduction in holding force for the terminal can be prevented.

(2) A plate portion is preferably provided which fills up a clearance between the surface portion and the resilient portion. According to this configuration, a displacement of the terminal arranged inside the cavity toward the open portion can be prevented. As a result, the escape of the protrusion from the recess can be prevented. Note that the plate portion can be inserted into between the resilient portion and the surface portion from front or behind. Further, behind this problem, there is a situation where a clearance is easily formed between the resilient portion and the surface portion when the resilient portion is resiliently deformed.

(3) The terminal may include a body portion and a slide portion to be arranged movably with respect to the body portion, the body portion may be provided with the protrusion and the surface portion and the slide portion may be provided with the plate portion. According to this configuration, the plate portion can be handled as a part of the terminal and it is not necessary to separately provide a dedicated component for the plate portion.

(4) An outer housing may be provided which covers the housing, and the outer housing may include a closing wall for closing the open portion. According to this configuration, the terminal can be reliably prevented from escaping to outside through the open portion.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

Figure 2:
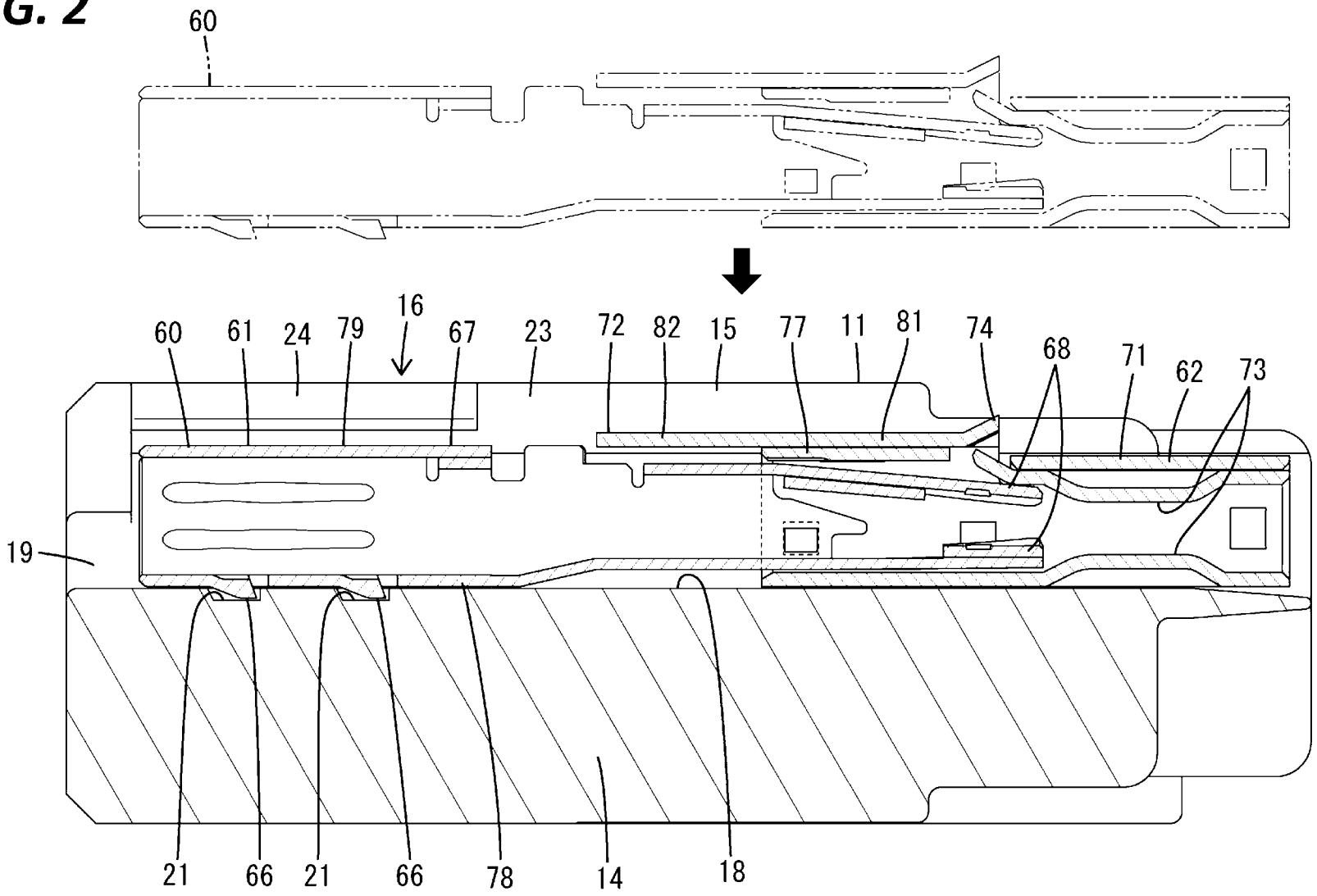
FIG. 2 is a side view in section showing a state where a terminal is arranged inside a cavity of a housing.
Figure 3:
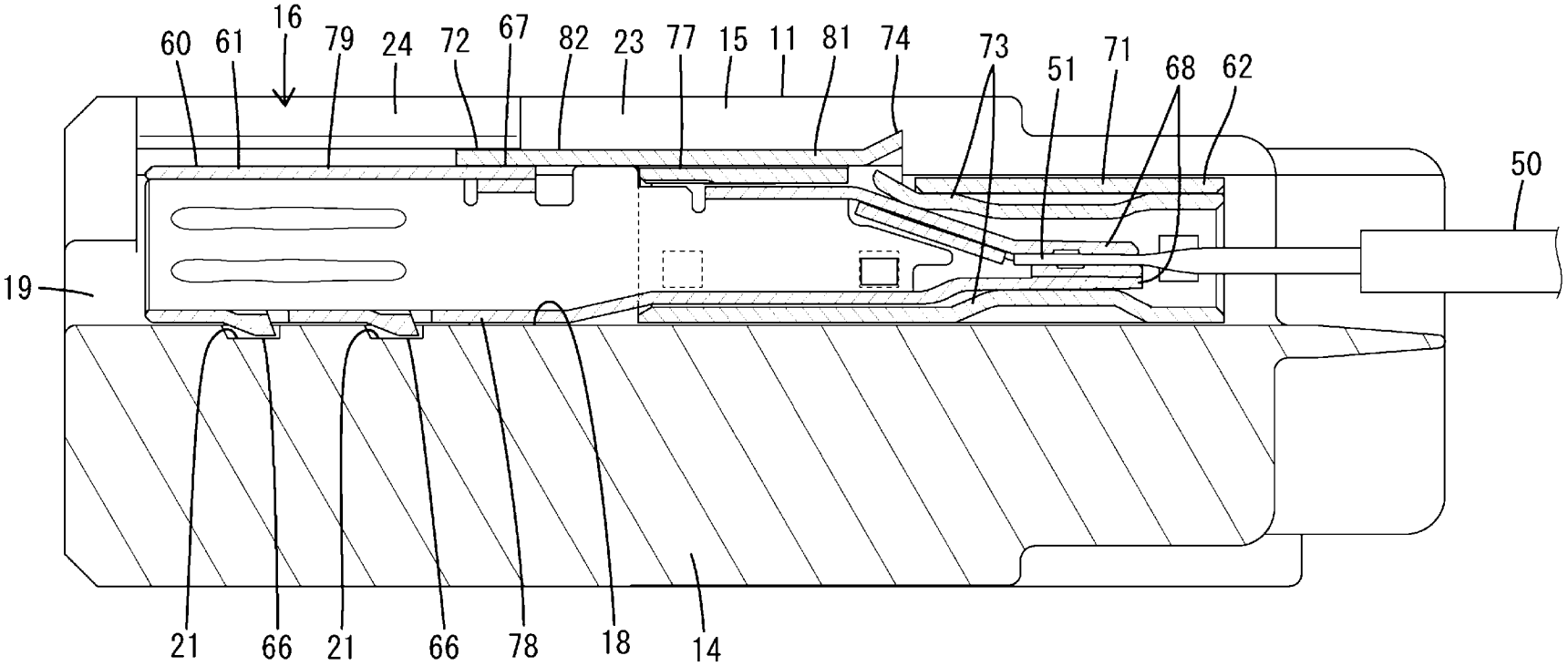
FIG. 3 is a side view in section showing a state where the terminal is connected to an end part of a wire by a movement of a sliding portion.

As shown in FIG. 1, a connector 10 of one embodiment includes a housing 11, an outer housing 12, a rear holder 13 and terminals 60. The connector 10 is connectable to an unillustrated mating connector. Note that, in the following description, a left side of FIGS. 2 and 3 is referred to as a front side concerning a front-rear direction. A vertical direction is based on a vertical direction of each of FIGS. 2 to 5. A lateral direction is based on a lateral direction of FIGS. 4 and 5. The mating connector is connected to the connector 10 from front.

(Housing)

Figure 5:
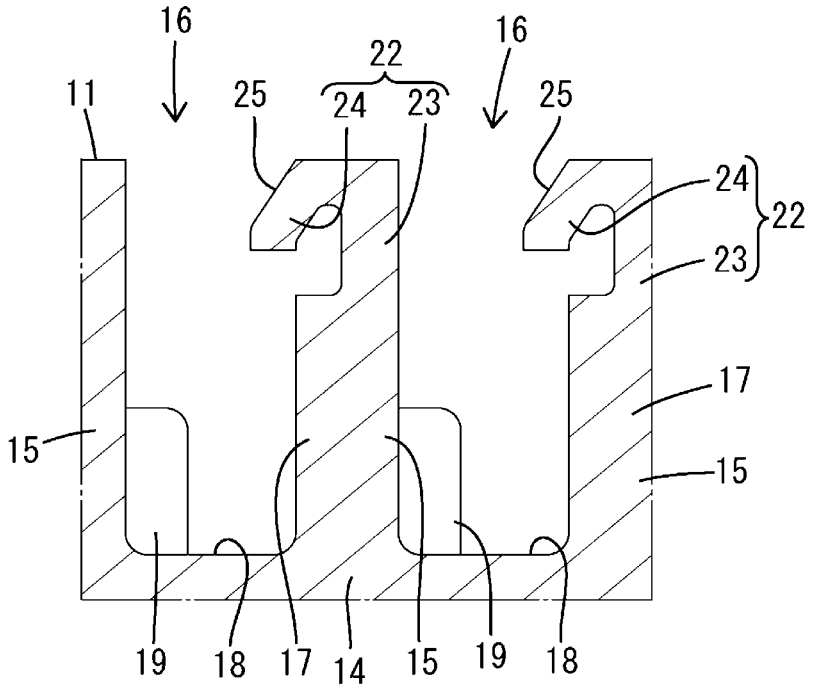
FIG. 5 is an enlarged transverse section showing the cavities of the housing.

The housing 11 is made of synthetic resin and includes a base wall 14 and a plurality of side walls 15 rising upward from the base wall 14. Further, as shown in FIG. 5, the housing 11 includes open portions 16 open upward on an upper surface side facing the base wall 14.

The base wall 14 constitutes a bottom wall of the housing 11. The inner surface (upper surface) of the base wall 14 is flatly arranged along the front-rear direction and lateral direction. The respective side walls 15 are arranged at intervals in the lateral direction on the inner surface of the base wall 14. Each side wall 15 includes a rising portion 17 having a constant thickness in a part except an upper end part. The rising portion 17 is arranged to rise perpendicularly from the base wall 14.

The housing 11 includes a plurality of cavities 18 arranged side by side in the lateral direction. Each cavity 18 is defined between the side walls 15 facing each other (adjacent) in the lateral direction, and is open upward via the open portion 16. The inner surface of the cavity 18 has a rectangular U-shaped cross-sectional shape and is composed of the inner surfaces of the side walls 15 laterally facing each other and the inner surface of the base wall 14.

The open portion 16 is an insertion opening through which the terminal 60 is inserted. The terminal 60 is inserted and accommodated into the cavity 18 from above through the open portion 16.

Each cavity 18 is also open forward and rearward of the housing 11. The housing 11 includes partial closing walls 19 for partially closing the front surfaces of the respective cavities 18. The partial closing wall 19 projects upward from the base wall 14 and is coupled to a lower part of the side wall 15.

Figure 4:
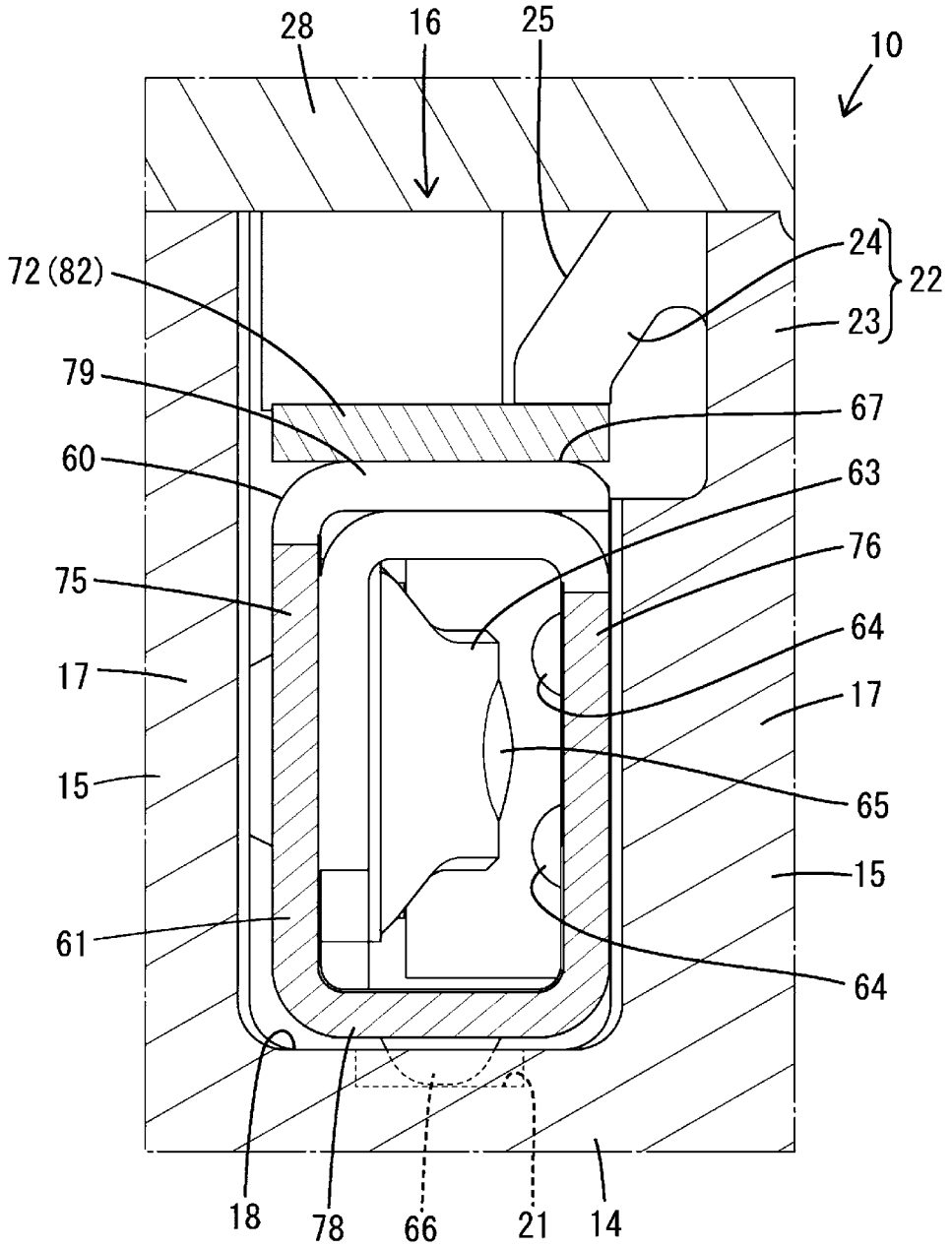
FIG. 4 is an enlarged transverse section showing a state where the terminal is properly arranged inside the cavity of the housing.

As shown in FIGS. 2 to 4, a plurality of recesses 21 are provided in a laterally central part of the inner surface of the base wall 14. The respective recesses 21 are bottomed rectangular recesses open only in the inner surface of the base wall 14 and arranged at an interval in the front-rear direction in the inner surface of the base wall 14.

As shown in FIG. 5, each side wall 15 includes a thin portion 22 thinner than the rising portion 17 on the upper end part. The thin portion 22 includes a projecting portion 23 projecting upward from one lateral side of the upper end of the rising portion 17, and a resilient portion 24 projecting obliquely downward into the cavity 18 from the upper end of a front part of the projecting portion 23.

As shown in FIGS. 2 and 3, the resilient portion 24 is shaped to extend rearward from the front end of the side wall 15 while having a constant cross-sectional shape in the front-rear direction. Each recess 21 described above is arranged in a formation range of the resilient portion 24 in the front-rear direction. A base end part (part connected to the projecting portion 23) of the resilient portion 24 is formed in a thickness range of the rising portion 17 (part having a maximum thickness of the side wall 15) in the lateral direction.

The resilient portion 24 has an obliquely downward guide surface 25 facing the open portion 16. The lower end (tip in a projecting direction) of the resilient portion 24 is facing in parallel to the inner surface of the base wall 14. The resilient portion 24 is laterally resiliently deformable with an upper end connected to the projecting portion 23 as a fulcrum.

The resilient portion 24 projects on one lateral side of the side wall 15, and a recessed part of the thin portion 22 is provided on an inner surface on the one lateral side of the side wall 15. The partial closing wall 19 is coupled to an inner surface of the thin portion 22 opposite to the inner surface having the recessed part as shown in FIG. 5.

(Outer Housing)

The outer housing 12 is made of synthetic resin and is, as shown in FIG. 1, in the form of a flat rectangular box and open rearward. The housing 11 can be accommodated into the outer housing 12 from behind. The outer housing 12 has a laterally long front wall 26. A plurality of tab insertion openings 27 are provided to be open in the front wall 26. With the housing 11 accommodated in the outer housing 12, the respective tab insertion openings 27 communicate with the respective cavities 18. Tabs of unillustrated mating terminals are inserted into the respective tab insertion openings 27. The mating terminals are provided in the mating connector.

The upper wall of the outer housing 12 serves as a closing wall 28 for closing the upper surface of the housing 11. The closing wall 28 is a plate wall along the front-rear direction and lateral direction. The open portions 16 of the housing 11 are closed by the closing wall 28 of the outer housing 12. A lock arm 29 is provided to project in a laterally central part of the upper surface of the closing wall 28. The lock arm 29 locks the mating connector and holds the both connectors in a connected state.

(Rear Holder)

The rear holder 13 is made of synthetic resin and, as shown in FIG. 1, has a flat shape and includes upper and lower lid bodies 31, which are openable and closable, in a rear part. The rear holder 13 is coupled to a rear part of the housing 11 via lock portions 32 provided on left and right sides. The rear holder 13 includes a plurality of wire accommodation holes 33 communicating with the respective cavities 18 in a front part. Wires 50 pulled out from the housing 11 are arranged inside the wire accommodation holes 33 with loose movements restricted. Note that the wire 50 is such a coated wire that a conductor 51 such as a core is covered with an insulation coating, and the conductor 51 is exposed in a tip part.

(Terminals)

Figure 6:
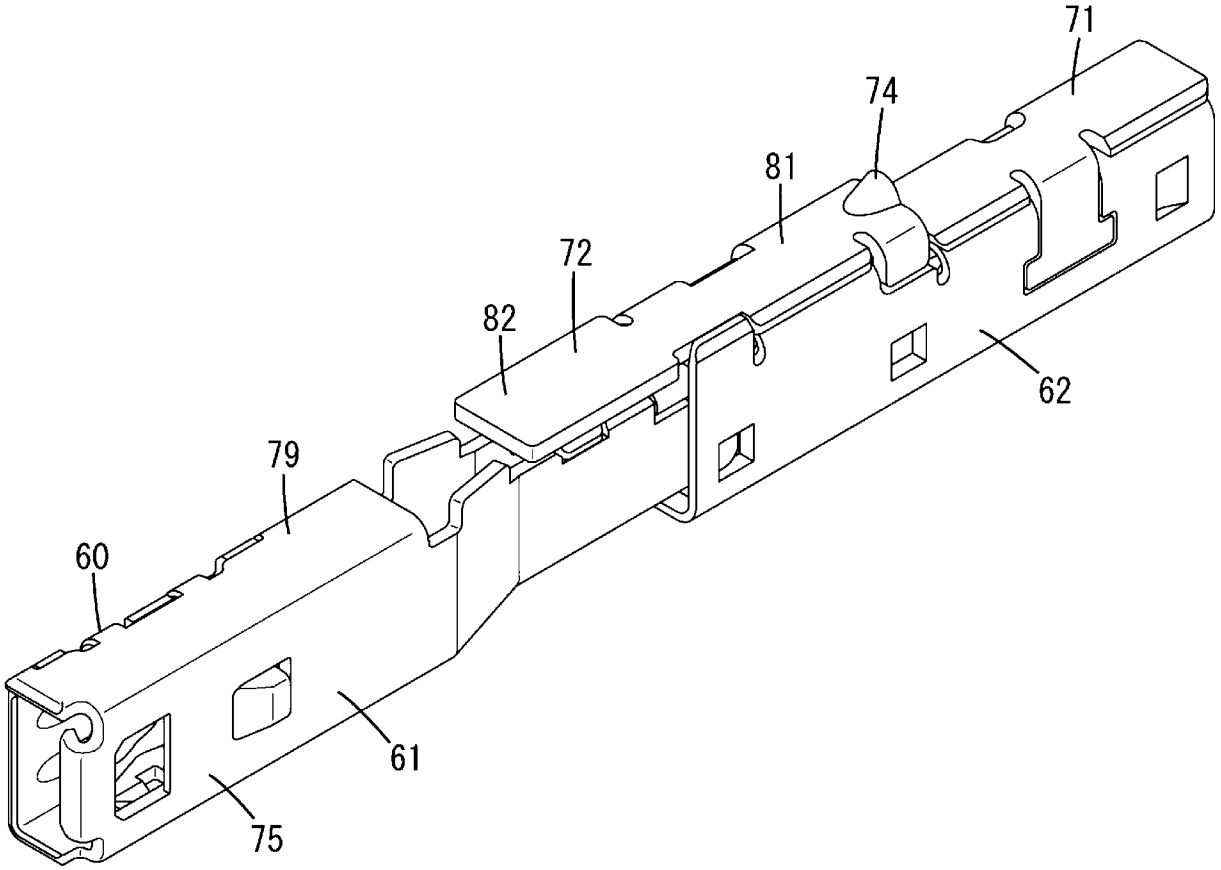
FIG. 6 is a perspective view of the terminal.

The terminal 60 is formed, such as by bending a metal plate. As shown in FIG. 6, the terminal 60 includes a body portion 61 in a front part and a slide portion 62 separate from the body portion 61 in a rear part. The slide portion 62 is assembled movably in the front-rear direction with respect to the body portion 61.

The body portion 61 is in the form of a rectangular tube as a whole and open forward and rearward. As shown in FIG. 4, the body portion 61 includes a resilient contact portion 63 on a side wall portion 75 on one side (left side of FIG. 4), out of left and right side wall portions 75, 76, and includes a pair of upper and lower beads 64 on the side wall portion 76 on the other side (right side of FIG. 4). The resilient contact portion 63 is in the form of a strip plate extending in the front-rear direction and arranged with plate surfaces facing in the lateral direction. The resilient contact portion 63 includes an emboss-like contact point portion 65 projecting toward a laterally central side inside the body portion 61. The respective beads 64 are in the form of ribs extending in the front-rear direction and facing the resilient contact portion 63. The respective beads 64 are arranged on both sides across the contact point portion 65 in the vertical direction.

The tab of the unillustrated mating terminal is inserted into the body portion 61 from front. The tab is sandwiched between the contact point portion 65 and the respective beads 64 with the resilient contact portion 63 deflected. In this way, the terminal 60 and the mating terminal are connected to each other.

A plurality of protrusions 66 are provided in a laterally central part of a lower wall 78 of the body portion 61. As shown in FIGS. 2 and 3, the respective protrusions 66 are arranged at an interval in the front-rear direction on the lower wall 78 of the body portion 61. The respective protrusions 66 are arranged in a formation range of the resilient contact portion 63 and the respective beads 64 in the front-rear direction. The protrusions 66 are formed by forming cuts in the lower wall 78 of the body portion 61 and bending parts of the lower wall 78 outward via the cuts. The front surfaces of the protrusions 66 are continuous with a lower surface region on a front side of the lower wall 78 and inclined rearward.

The body portion 61 has a flat surface portion 67 along the front-rear direction and lateral direction on the upper surface of an upper wall 79. The surface portion 67 is arranged to face the resilient portion 24 with a clearance defined between the lower end of the resilient portion 24 and the surface portion 67 in a state where the terminal 60 is inserted in the cavity 18.

As shown in FIGS. 2 and 3, the body portion 61 includes, in a rear part, upper and lower contact pieces 68 inclined downward toward a rear side from the side of the upper wall 79 and inclined upward toward the rear side from the side of the lower wall 78.

The slide portion 62 includes a fitting portion 71 in the form of a rectangular tube and a plate portion 72 in the form of a flat plate projecting further forward than the fitting portion 71. The fitting portion 71 is fit to the body portion 61 to cover the rear part of the body portion 61 from outside. The fitting portion 71 includes upper and lower pressing portions 73 bent inwardly from the sides of the upper and lower walls 79, 78 to narrow a vertical interval. With the slide portion 62 assembled with the body portion 61, inclined regions in front parts of the pressing portions 73 can face the contact pieces 68 from behind and slide thereon.

As shown in FIGS. 2 and 3, a rear part 81 of the plate portion 72 overlaps a front part of an upper wall portion 77 of the fitting portion 71 from outside (above). A projection 74 is provided to project on the rear part 81 of the plate portion 72. As shown in FIG. 6, the projection 74 is formed by bending and raising a laterally central part of the rear end of the rear part 81 of the plate portion 72 outward. The projection 74 is an operating projection to be pressed when the slide portion 62 is moved with respect to the body portion 61.

A front part 82 of the plate portion 72 is in the form of a strip plate continuous from the rear part 81 without any step and flat along the front-rear direction and lateral direction. The front part 82 of the plate portion 72 projects further forward than the front end of the fitting portion 71. At a slide completion position where the movement of the slide portion 62 with respect to the body portion 61 is completed, a tip side of the front part 82 of the plate portion 72 overlaps the surface portion 67 of the body portion 61 from outside and is arranged to be sandwiched between the surface portion 67 and the resilient portion 24 as shown in FIGS. 3 and 4.

(Connector Assembling Method and Connector Structure)

In assembling the connector 10, the slide portion 62 is first fit to the rear part of the body portion 61 and assembled at an initial position with respect to the body portion 61 in the terminal 60 as shown in FIG. 2. When the slide portion 62 is at the initial position, the pressing portions 73 are arranged to face the contact pieces 68 from behind. Further, when the slide portion 62 is at the initial position, the tip side of the front part 82 of the plate portion 72 is arranged behind and away from the surface portion 67 of the body portion 61.

Subsequently, the terminal 60 is inserted into the cavity 18 of the housing 11 through the open portion 16 from above. In the process of inserting the terminal 60, the lower wall 78 and the side wall portion 76 of the body portion 61 slide in contact with the guide surface 25 of the resilient portion 24 and the resilient portion 24 is resiliently deformed toward the projecting portion 23. When the insertion of the terminal 60 is completed, the respective protrusions 66 of the terminal 60 are fit into the corresponding recesses 21 from above. As shown in FIG. 2, the rear ends of the respective protrusions 66 face the rear surfaces of the respective recesses 21 in such a manner as to be able to contact the rear surfaces of the respective recesses 21, whereby a rearward displacement of the terminal 60 is restricted. A forward displacement of the terminal 60 is restricted mainly by the front end of the body portion 61 facing the partial closing wall 19 in such a manner as to be able to contact the partial closing wall 19.

Further, when the insertion of the terminal 60 is completed, the resilient portion 24 resiliently returns and the surface portion 67 of the body portion 61 is arranged to face the resilient portion 24 from below (from a side opposite to the open portion 16). In this way, the escape of the terminal 60 from the cavity 18 is restricted. Since the lower end of the resilient portion 24 turns along an arcuate rotational locus during resilient deformation, the clearance is formed between the lower end of the resilient portion 24 and the surface portion 67 of the body portion 61 as shown in FIG. 2. Note that a width of the terminal 60 is smaller than a distance between the inner surfaces of the left and right side walls 15. Thus, after the resilient portion 24 resiliently returns, the terminal 60 is smoothly inserted into the cavity 18 without largely interfering with the left and right side walls 15.

Subsequently, the conductor 51 exposed in the tip part of the wire 50 is inserted between the upper and lower pressing portions 73 and between the upper and lower contact pieces 68. In that state, an unillustrated jig is pressed against the projection 74 and the projection 74 is pressed forward. As the projection 74 is pressed, the slide portion 62 moves forward with respect to the body portion 61. During this time, the respective pressing portions 73 vertically sandwich the corresponding contact pieces 68, which are displaced toward each other. When the slide portion 62 reaches the slide completion position as shown in FIG. 3, the conductor 51 of the wire 50 is vertically sandwiched by the respective contact pieces 68 and the terminal 60 and the wire 50 are connected to each other.

Further, when the slide portion 62 is moved forward with respect to the body portion 61, the tip side of the front part 82 of the plate portion 72 approaches the surface portion 67 of the body portion 61. When the slide portion 62 reaches the slide completion position as shown in FIGS. 3 and 4, the tip side of the front part 82 of the plate portion 72 is arranged to enter between the surface portion 67 of the body portion 61 and the lower end of the resilient portion 24. In this way, the clearance between the tip side of the front part of the resilient portion 24 and the surface portion 67 of the body portion 61 is filled up and an upward displacement of the terminal 60 is effectively suppressed.

Subsequently, the rear holder 13 is mounted on the housing 11 from behind. Further, the outer housing 12 is mounted on the housing 11 from front. In this way, the assembling of the connector 10 is completed. In the assembled connector 10, the housing 11 is covered by the outer housing 12. The closing wall 28 of the outer housing 12 is arranged between the side walls 15 on the left and right sides of the housing 11. Thus, as shown in FIG. 4, the open portions 16 of the housing 11 are closed by the closing wall 28 of the outer housing 12. Thus, the escape of the terminals 60 from the cavities 18 is more reliably restricted by the closing wall 28.

As described above, according to this embodiment, if the terminal 60 is inserted into the cavity 18 through the open portion 16, the protrusions 66 are arranged inside the recesses 21 to restrict a displacement of the terminal 60 in the front-rear direction. Further, the surface portion 67 is arranged to face the resilient portion 24, whereby the escape of the terminal 60 through the open portion 16 is restricted. Thus, the terminal 60 needs not be forcibly inserted into the cavity 18 and a concern of breaking the housing 11 can be reduced. As a result, a reduction in the holding force of the housing 11 for the terminal 60 can be prevented.

Particularly, a displacement of the terminal 60 toward the open portion 16 can be effectively suppressed by filling up the clearance between the surface portion 67 and the resilient portion 24 by the plate portion 72. Further, since the plate portion 72 is constituted as a part of the terminal 60, it is not necessary to provide a dedicated component as the plate portion 72.

Furthermore, since the open portions 16 of the housing 11 are closed by the closing wall 28 of the outer housing 12 by covering the housing 11 with the outer housing 12, the terminals 60 can be reliably prevented from escaping to outside through the open portions 16.

Other Embodiments of Present Disclosure

The embodiment disclosed this time should be considered illustrative in all aspects, rather than restrictive.

Although the resilient portion is provided to project on one lateral side of the side wall in the case of the above embodiment, a pair of resilient portions may be provided to project on both left and right sides of a side wall as another embodiment.

Although the recesses are bottomed recesses open only in the inner surface of the base wall in the case of the above embodiment, the recesses may be bottomless recesses penetrating through the base wall in a thickness direction as another embodiment.

Although the plurality of recesses are provided at an interval in the front-rear direction in the case of the above embodiment, only one recess may be provided in a base wall as another embodiment.

Although the plate portion is a part of the terminal in the case of the above embodiment, the plate portion may be constituted by a plate member separate from a terminal as another embodiment.

Although the slide portion is configured to move with respect to the body portion for connection to the wire in the case of the above embodiment, the slide portion may be configured to simply move with respect to the body portion for any purpose as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising: a housing including a plurality of cavities extending in a front-rear direction; and at least one terminal to be arranged inside the cavities, wherein: the housing includes a base wall, left and right side walls rising from the base wall in a direction intersecting the front-rear direction, and an open portion open outward at a position facing the base wall, an inner surface of the base wall and inner surfaces of the left and right side walls constitute an inner surface of each of the cavities, a recess is provided in the inner surface of the base wall for each of the cavities, a resiliently deformable resilient portion is provided to project toward the inside of each of the cavities on at least one of the left and right side walls, the terminal includes a protrusion to be arranged inside the recess and a surface portion facing the resilient portion from a side opposite to the open portion; a plate portion for filling up a clearance between the surface portion and the resilient portion; wherein the terminal includes a body portion and a slide portion to be arranged movably with respect to the body portion, the body portion is provided with the protrusion and the surface portion and the slide portion is provided with the plate portion; wherein when the protrusion of the terminal is arranged inside the recess and the slide portion slides to a slide completion position, the plate portion contacts the surface portion and the resilient portion.

2. The connector of claim 1, comprising an outer housing for covering the housing, wherein:

the outer housing includes a closing wall for closing the open portion.

3. The connector of claim 1, wherein the plate portion has a thickness substantially equal to the clearance between the surface portion and the resilient portion.

4. The connector of claim 1, wherein when the protrusion of the terminal is arranged inside the recess and the slide portion slides to a slide completion position, the resilient portion presses the plate portion to press the protrusion against the recess.

5. A connector, comprising:

a housing including a cavity extending in a front-rear direction; and a terminal to be arranged inside the cavity, wherein:

the housing includes a base wall, left and right side walls rising from the base wall in a direction intersecting the front-rear direction, and an open portion open outward at a position facing the base wall, an inner surface of the base wall and inner surfaces of the left and right side walls constitute an inner surface of the cavity, a recess is provided in the inner surface of the base wall, a resiliently deformable resilient portion is provided to project toward the inside of the cavity on at least one of the left and right side walls, the terminal includes a protrusion to be arranged inside the recess and a surface portion facing the resilient portion from a side opposite to the open portion, and the connector further comprises a plate portion configured to fill up a clearance between the surface portion and the resilient portion and having a thickness substantially equal to the clearance between the surface portion and the resilient portion.

* * * * *